US010857562B2

(12) United States Patent
Kite et al.

(10) Patent No.: US 10,857,562 B2
(45) Date of Patent: Dec. 8, 2020

(54) STRING FILTER

(71) Applicant: ALTRIA CLIENT SERVICES LLC, Richmond, VA (US)

(72) Inventors: Carl Patrick Kite, Midlothian, VA (US); Linwood Carneal, Richmond, VA (US); Joshua Brock Craft, Chester, VA (US); Richard Kevin Barnhouse, North Dinwiddie, VA (US)

(73) Assignee: Altria Client Services LLC, Richmond, VA (US)

( * ) Notice: Subject to any disclaimer, the term of this patent is extended or adjusted under 35 U.S.C. 154(b) by 15 days.

(21) Appl. No.: 15/681,383

(22) Filed: Aug. 19, 2017

(65) Prior Publication Data

US 2019/0054489 A1 Feb. 21, 2019

(51) Int. Cl.

| | |
|---|---|
| ***B07B 7/00*** | (2006.01) |
| ***B05B 15/52*** | (2018.01) |
| ***A24D 3/02*** | (2006.01) |
| ***A24B 3/18*** | (2006.01) |
| ***A24B 1/04*** | (2006.01) |
| ***B07B 13/00*** | (2006.01) |
| *A24C 5/00* | (2020.01) |

(52) U.S. Cl.

CPC ..... *B05B 15/52* (2018.02); *A24B 1/04* (2013.01); *A24B 3/18* (2013.01); *A24D 3/0295* (2013.01); *B07B 7/00* (2013.01); *B07B 13/003* (2013.01); *A24C 5/00* (2013.01)

(58) Field of Classification Search

CPC ..... B07B 7/01; B07B 13/003; B07B 13/16; A24B 1/04; A24B 3/18; A24D 3/0295; B05B 15/52

USPC ..... 209/615, 671, 908, 911

See application file for complete search history.

(56) References Cited

U.S. PATENT DOCUMENTS

| | | | | |
|---|---|---|---|---|
| 2,127,423 A | | 10/1936 | Roberts, Jr. et al. | |
| 2,634,171 A | | 4/1953 | Williams | |
| 3,189,034 A | | 6/1965 | Molins | |
| 3,308,945 A | * | 3/1967 | Oja | C03B 37/10 209/138 |
| 3,311,114 A | | 3/1967 | Schlossmacher | |
| 3,365,083 A | | 1/1968 | Baumann et al. | |

(Continued)

FOREIGN PATENT DOCUMENTS

| | | |
|---|---|---|
| CN | 105731074 | 7/2016 |
| EP | 1462014 | 9/2004 |

(Continued)

OTHER PUBLICATIONS

International Search Report and Written Opinion for corresponding International Application No. PCT/IB2018/056218 dated Nov. 30, 2018.

*Primary Examiner* — Joseph C Rodriguez

(74) *Attorney, Agent, or Firm* — Harness, Dickey & Pierce, P.L.C.

(57) ABSTRACT

Example embodiments include a system for removing string from shredded tobacco, including an arrangement configured to dispense shredded tobacco from a first location to a second location along a path of communication, a string filter operative at a location along the path of communication comprising a first roller comprising pins, whereby string may be contacted by at least some of the pins and retained at the string filter as the shredded tobacco passes through the filter.

16 Claims, 8 Drawing Sheets

(56) References Cited

U.S. PATENT DOCUMENTS

| | | | | | |
|---|---|---|---|---|---|
| 3,380,782 | A | | 4/1968 | Labbe | |
| 3,989,309 | A | | 11/1976 | Preston | |
| 4,175,570 | A | | 11/1979 | Heitmann | |
| 4,251,356 | A | * | 2/1981 | Harte | A24B 1/04 209/143 |
| 4,459,999 | A | * | 7/1984 | Brackmann | A24C 5/392 131/109.1 |
| 4,491,138 | A | | 1/1985 | Labbe | |
| 4,729,388 | A | * | 3/1988 | Mattei | A24C 5/396 131/109.2 |
| 4,802,497 | A | | 2/1989 | Hrboticky | |
| 5,199,448 | A | * | 4/1993 | Parker | A24B 1/04 131/110 |
| 5,299,583 | A | * | 4/1994 | Lasch | A24B 1/04 131/302 |
| 5,322,074 | A | | 6/1994 | Cross, Jr. | |
| 5,325,875 | A | * | 7/1994 | Coleman | A24B 1/04 131/109.2 |
| 5,477,869 | A | | 12/1995 | Cross, Jr. | |
| 8,281,931 | B2 | * | 10/2012 | Drewes | H04N 7/188 209/154 |
| 2011/0303373 | A1 | | 12/2011 | Young et al. | |
| 2017/0129637 | A1 | * | 5/2017 | Benjamins | B65B 69/0025 |

FOREIGN PATENT DOCUMENTS

| | | |
|---|---|---|
| EP | 2982251 | 2/2016 |
| GB | 294501 | 7/1928 |
| WO | WO-02/26064 | 4/2002 |

* cited by examiner

STRING FILTER

FIELD

The present disclosure relates generally to apparatuses and techniques for minimizing unwanted foreign material at a processing machine and more particularly, to apparatuses and techniques for minimizing string at a tobacco processing machine.

ENVIRONMENT

Techniques and apparatuses exist for the removal of string that may accompany oriental tobaccos or other varieties. Such varieties may be marketed and/or delivered to cigarette manufacturers in burlap bags and the like. String content in tobacco may comprise string segments separated from the burlap bags, remnants of string used in sun-curing of certain oriental tobaccos, and/or string from other sources.

String doffers have been implemented at stemmeries wherein stripped tobacco is spread out upon a conveyor and contacted with the rotatable doffers having surfaces textured to pick string and other foreign matter from the tobacco as it passes beneath the doffers. String doffers are rather large and have significant space requirements within the facility, because the tobacco must be spread out sufficiently to be in a condition that would facilitate picking with the doffers. Some facilities employ persons to inspect a conveyed stream of tobacco for foreign materials and to remove it by manual picking.

Current high-speed automated cigarette making machines may include winnowers which are operative to separate long stem pieces from cut filler as the cut filler tobacco is presented to an underside of a vacuum tape, where a column of tobacco is established and fed into a wrapping section of the machine. The content that is winnowed from the cut filler may be subject to an inspection, in particular, inspection for the presence of string material. The presence of string may indicate a need to recover and hold product produced during that production run, so that it may be confirmed or denied whether other pieces of the string material may have worked their way into the product.

It is desirable to resolve additional techniques and apparatuses to remove string content from tobacco.

SUMMARY

An aspect of the present disclosure provides a system for removing string from shredded tobacco, comprising an arrangement configured to dispense shredded tobacco from a first location to a second location along a path of communication, and a string filter operative at a location along the path of communication comprising a roller comprising pins, whereby string may be contacted by at least some of the pins and retained at the string filter as the shredded tobacco passes through the filter.

In some embodiments, the dispensing arrangement may draw shredded tobacco along a conduit, with the string filter being operative at a location along the conduit, and whereby the dispensed shredded tobacco may be in a dispersed condition upon arrival at the string filter. The dispensing arrangement may draw shredded tobacco along the conduit with a vacuum fan.

In further embodiments, the string filter may comprise a plurality of rollers, the rollers may be substantially aligned with each other in a straight line from a side planar view and a front planar view, and each roller may be configured to rotate in a rotational direction opposite to a rotational direction of an adjacent roller.

In some embodiments, a roller may comprise a cylindrical body and the pins may extend radially from the cylindrical body. At least some of the pins may be cylindrical and/or tapered in whole or in part, and may include a rounded free end. At least some of the pins and/or at least some of the cylindrical body may include a textured surface configured to promote retention of string, such as knurled, threaded, crosshatched, dimpled, or any other type of textured surface.

In further embodiments, the string filter may further comprise a housing, with the housing providing an enclosure for the roller. The housing may include a door configured to provide access to the roller when opened. The string filter may further comprise releasable mount for the roller so as to facilitate removal of the roller from the housing.

In some embodiments, the string filter may further comprise a housing, with the housing providing an enclosure for a plurality of rollers and/or with the housing including an arcuate baffle extending laterally toward a nip space defined between adjacent rollers of the plurality of rollers. The housing may include first and second baffles extending laterally from opposing side portions of the housing toward each other. At least one of the baffles may direct the shredded tobacco from one of the rollers toward a central portion of an adjacent roller.

In some embodiments, at least one adjacent pair of a plurality of rollers may be spaced further apart from one another than rollers of another pair of adjacent rollers of the plurality of rollers. In other embodiments all pairs of rollers may be equally spaced apart.

In some embodiments, a driver may rotate rollers at a common rotational direction, at the same rotational speed, at different rotational speeds and/or at different rotational directions.

Another aspect of the present disclosure provides a method of removing string from shredded tobacco. The method may include dispensing shredded tobacco from a first location to a second location, and while dispensing, filtering the shredded tobacco of string with a string filter by contacting at least some of the shredded tobacco with pins of a roller while rotating the roller, whereby string may be contacted by at least some of the pins and retained at the string filter as the shredded tobacco passes through the filter.

Another aspect of the present disclosure includes a system for removing foreign matter from shredded material, where the foreign matter may be something other than string but different than the shredded material, and the shredded material may be tobacco or something other than tobacco.

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1:
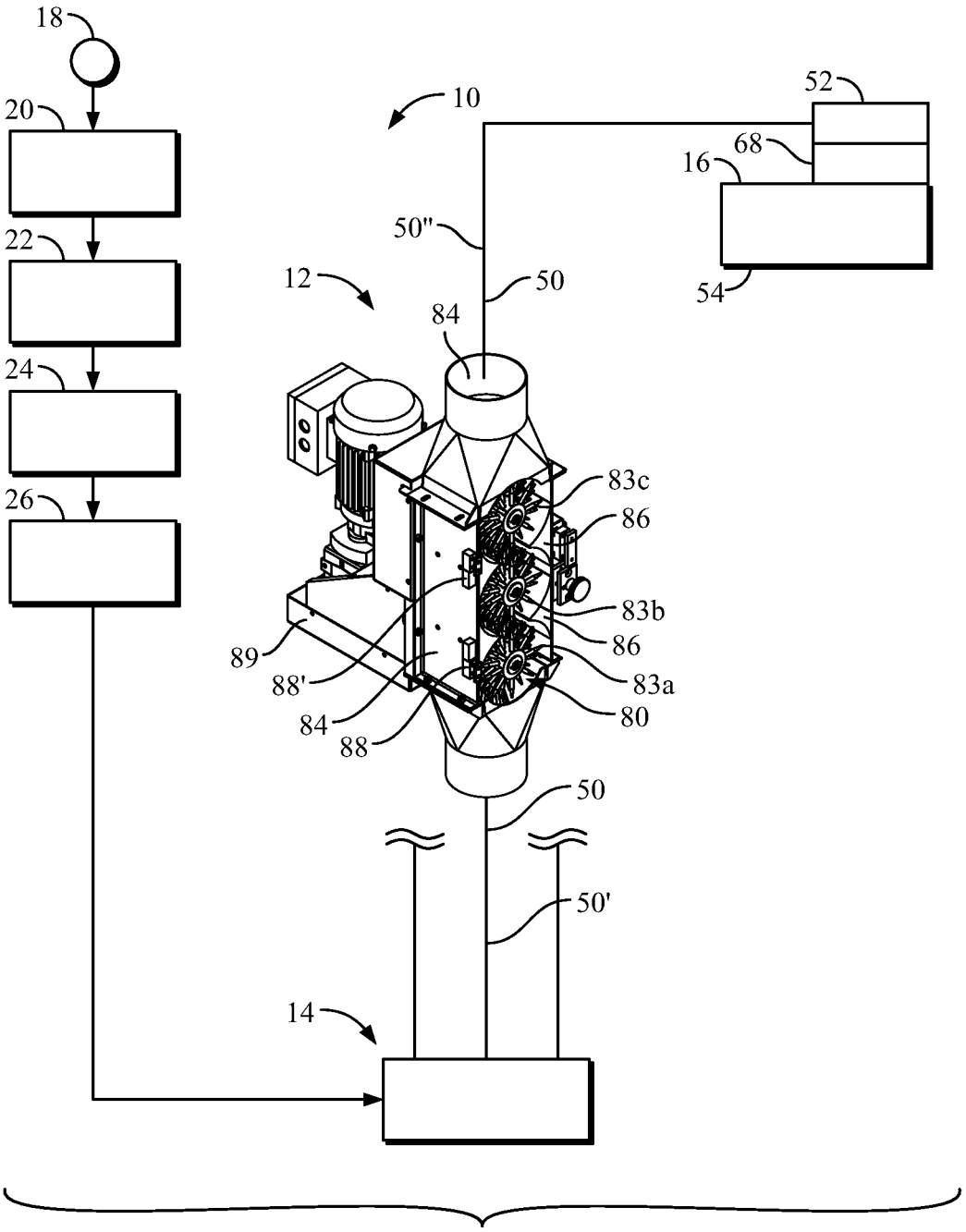
FIG. 1 is a schematic flow diagram of an example of a progression of steps undertaken to prepare tobacco for production of cigarettes, together with a perspective view of a string filter constructed in accordance with an embodiment of the present disclosure.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "'having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Specific forms will now be described further by way of example. While the following examples demonstrate certain forms of the subject matter disclosed herein, they are not to be interpreted as limiting the scope thereof, but rather as contributing to a complete description.

Figure 2A:
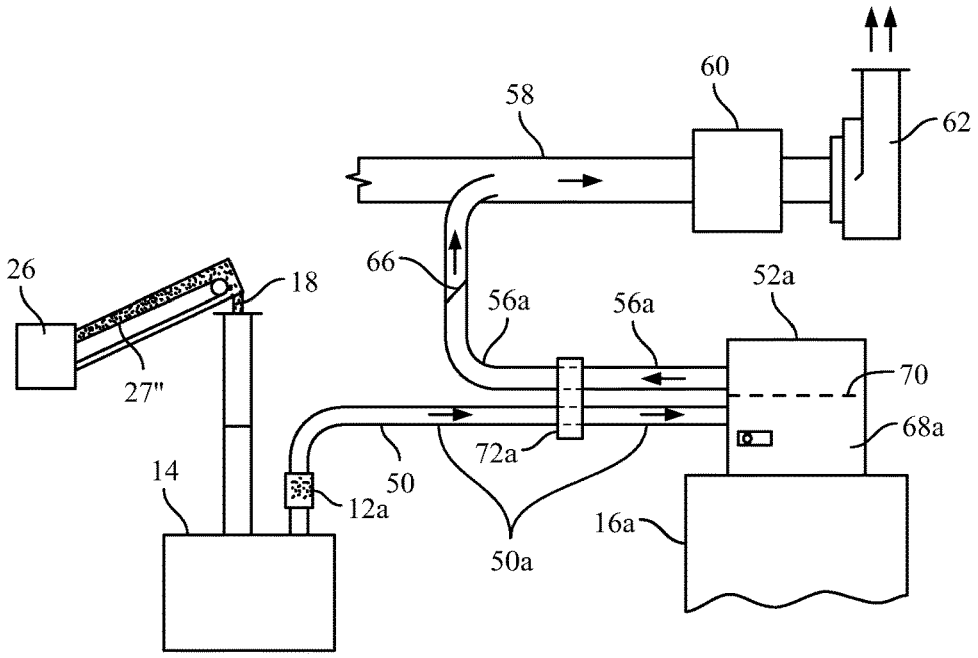
FIG. 2A is a side planar representation of an example of a system layout for production of cigarettes that includes the string filter of FIG. 1.

Referring now to FIGS. 1 and 2A, an embodiment of the present disclosure provides a process 10 comprising a progression of steps of how harvested tobacco may be processed into cigarettes, which process 10 includes use of a string filter 12 which may be interposed between a tobacco feeder 14 and a tobacco rod maker 16. The string filter 12 may be configured to retain string content of tobacco as the tobacco passes through the filter 12.

Referring specifically to FIG. 1, harvested (cured) tobacco 18 is directed to a stemmery 20, where the tobacco leaf is thrashed to separate lamina of the leaf from its mid-rib. Thereafter, the output of the stemmery is loaded into containers such as hogsheads or large corrugated boxes and stored at a warehouse 22 until sufficient time has passed to achieve a desired amount of aging for the particular grade and variety of tobacco and for storage until such time for it to be selected for cigarette making operations. Thereafter, the containers may be sent to a primary 24 of a cigarette manufacturing facility where the containers are opened and the contents processed into cut filler tobacco suitable for tobacco rod making operations at the facility. The operations at the primary may include conditioning, blending, shredding and other preparatory processes. When readied for cigarette making operations, the cut filler tobacco may be directed to a bulk container or silo 26 for dispensing to the tobacco feeder 14. Certain of the operations include transfer of the tobacco along conveyors 27, 27', 27" such as shown in FIG. 2C.

Despite the effectiveness of the aforementioned processes for detecting and removing string from tobacco coming into the primary 24, string segments may be nonetheless found in the rod maker 16 and therefore product would be placed on hold for inspection and testing to confirm an absence of string in that product stream.

Figure 2B:
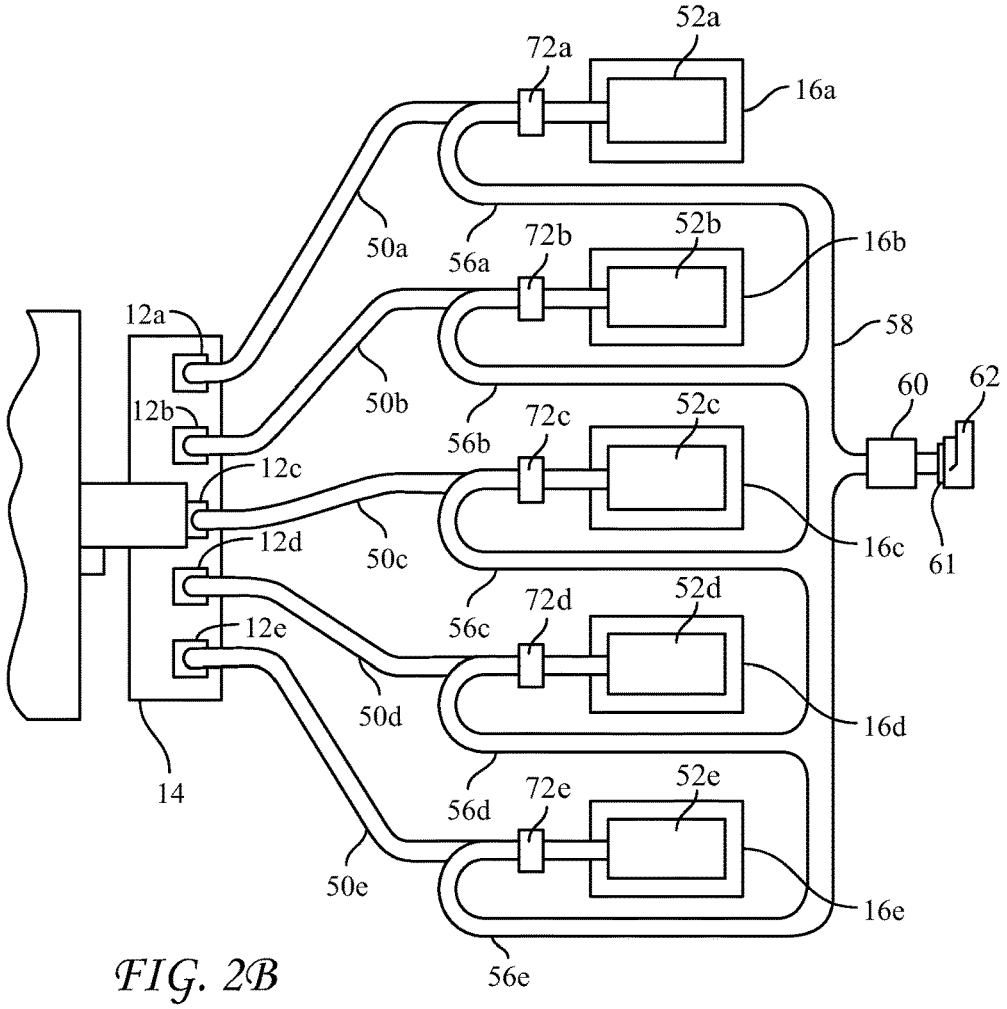
FIG. 2B is a top planar embodiment of the system layout shown in FIG. 2A.
Figure 2C:
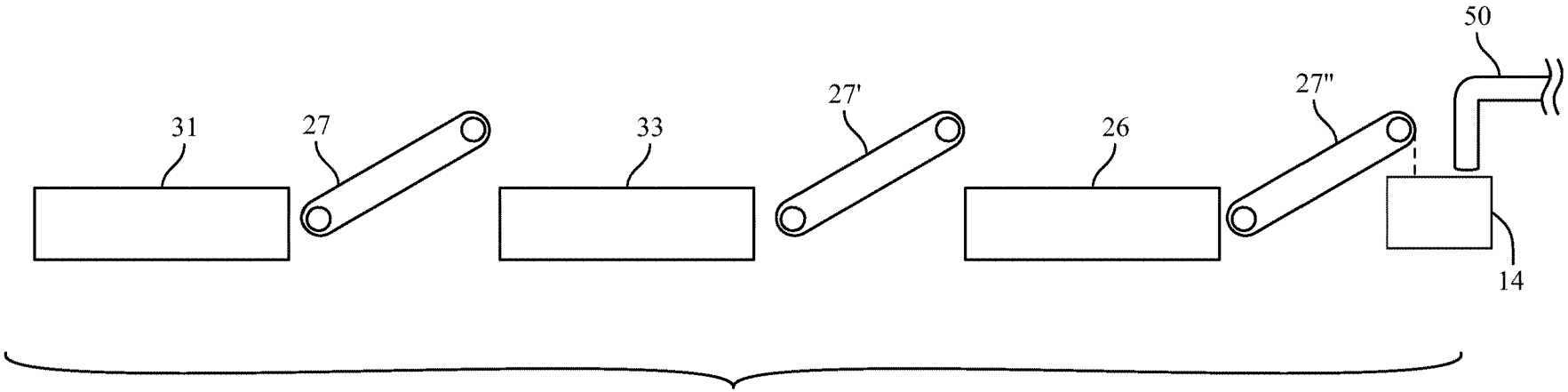
FIG. 2C is a side planar embodiment of a portion of the system layout of FIG. 2A where conveyors communicate one apparatus to another, amongst others.

Referring now specifically to FIGS. 2A and 2B, in certain embodiments each of the dischargers 52*a-e* may communicate with a corresponding hopper 68*a-e* (an example hopper 68*a* is shown in FIG. 2A below discharger 52*a*; hoppers 68*b-e* may be similarly placed) of a respective cigarette making machine 16*a-e* through a screen 70 (shown in FIG. 2A between discharger 52*a* and hopper 68*a*). The screen may be arranged to retain the tobacco but allow the incoming air to pass on to vacuum fan 62. The flow of air through any hopper 68*a-e* of any of the dischargers 52*a-e* may be stopped and started by suitable air valves 72*a-e* and a controller to facilitate transfer of tobacco to the hoppers 68*a-e*.

Referring now to FIGS. 1, 2A and 2B, in accordance with an exemplary embodiment, string filters 12*a-e* may be operatively interposed between the tobacco feeder 14 and each of a tobacco rod makers 16*a-e*, respectively, wherein the respective string filter 12 may be configured to retain string content of tobacco being fed to the respective cigarette rod maker 16*a-e* as the tobacco flows through the string filter.

Instead of having a string filter 12 for each of the rod makers 16*a-e* as shown in FIG. 2B (i.e., string filters 12*a-e*), in certain embodiments less or more string filters may be used. For example, in certain embodiments half the number of filters may be used (compared to the number of tobacco rod makers), and the tobacco flow may be first split into half the number of flows as those that ultimately lead to the tobacco makers. For example, there may be six tobacco rod makers 16 but only three filters 12, and the flow of tobacco may be first split into three flows, each pass through a filter 12, and then the three flows may be further split into six flows that are received by the six tobacco makers. In other embodiments, for example, a third, a fourth, a fifth, etc. of the number of filters may be used (compared to the number of tobacco rod makers), and the tobacco flow may be first split into a third, a fourth, a fifth, etc. of the number of flows as those that ultimately lead to the tobacco rod makers. In other embodiments, for example, only one string filter 12 may be used and placed in a location before the tobacco flow is split into multiple flows. Other setups may be used with more or less filters 12. In certain embodiments only one filter 12 and one tobacco rod maker 16 may be used.

Figure 4:
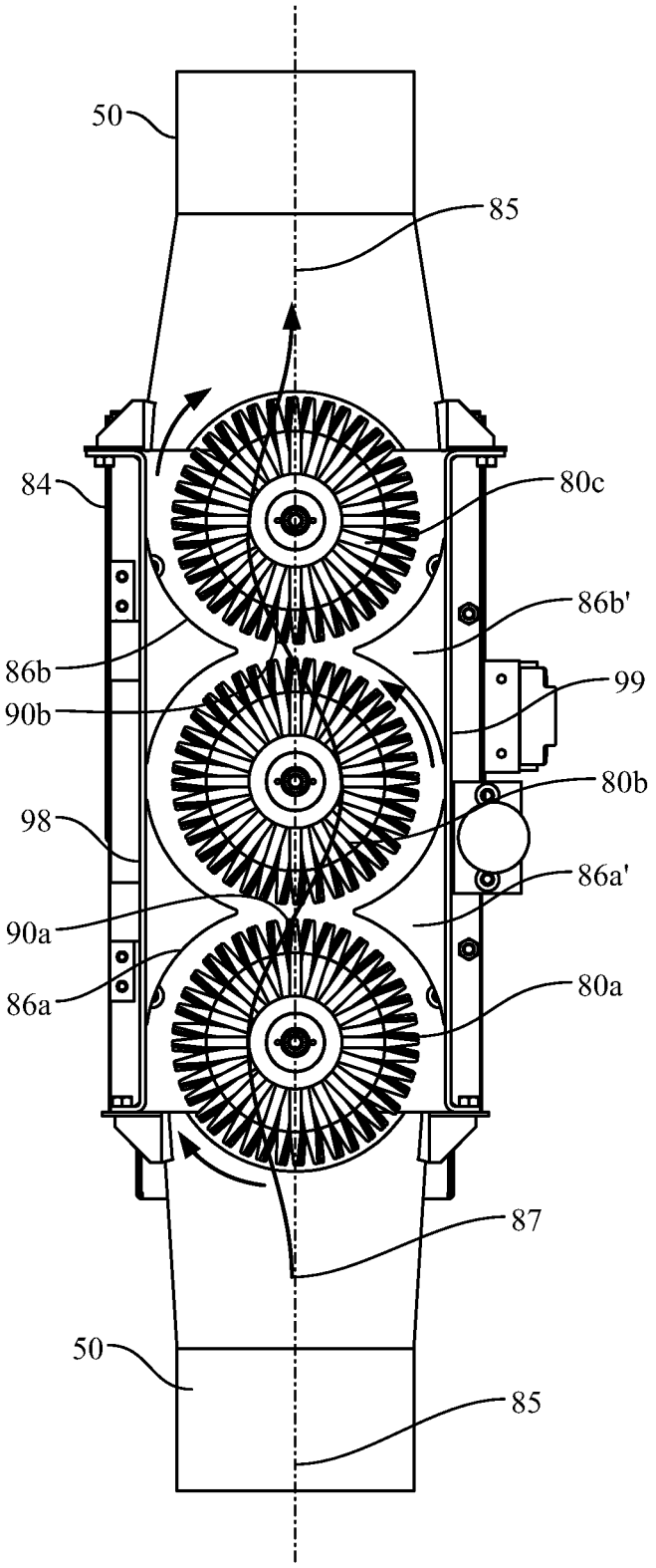
FIG. 4 is a frontal planar view of the string filter shown in FIG. 1 according to an embodiment.

Referring now to FIGS. 1 and 4, in certain embodiments, the string filter 12 may comprise one or more rotatably driven rollers 80 comprising pins 83, and a housing 84 of a mostly rectangular form which encloses the rollers 80 and may include internal baffles 86 adjacent the rollers 80 to favorably direct flowing tobacco through the string filter 12. In certain embodiments, string may be removed from the flowing tobacco with little to no physical degradation of the tobacco shreds.

In certain embodiments, the housing 84 includes a lower adapter section which is configured to facilitate secure connection of the housing 84 with a lower pipe portion 50' leading from the feeder 14, and an upper adapter section which is configured to facilitate secure connection of the housing 84 with an upper pipe portion 50" leading to a discharger 52 in the area of a rod maker 16.

In certain embodiments, the string filter 12 may be provided with a hinged window (transparent door) 184 (see FIG. 3), which may be opened and closed via hinges 88, 88'. When closed, the hinged window 184 prevents escape of tobacco shreds as a flow of tobacco passes through the string filter 12 and facilitates monitoring of the rollers 80 for capture of string. The monitoring may be conducted either with the human eye or a sensor or other suitable machine vision technology. When opened, the hinged window 184 may provide a machine operator or a robot access to the rollers 80 and any string that may be retained thereon.

In certain embodiments, rollers 80 are releasably mounted within housing 84 by a suitable releasable connection 89 (shown as an example for one of the rollers in FIG. 3) so that one or more of the rollers 80 may be removed from the housing 84 for cleaning and speedy return to within the housing 84 (or replacement).

Figure 3:
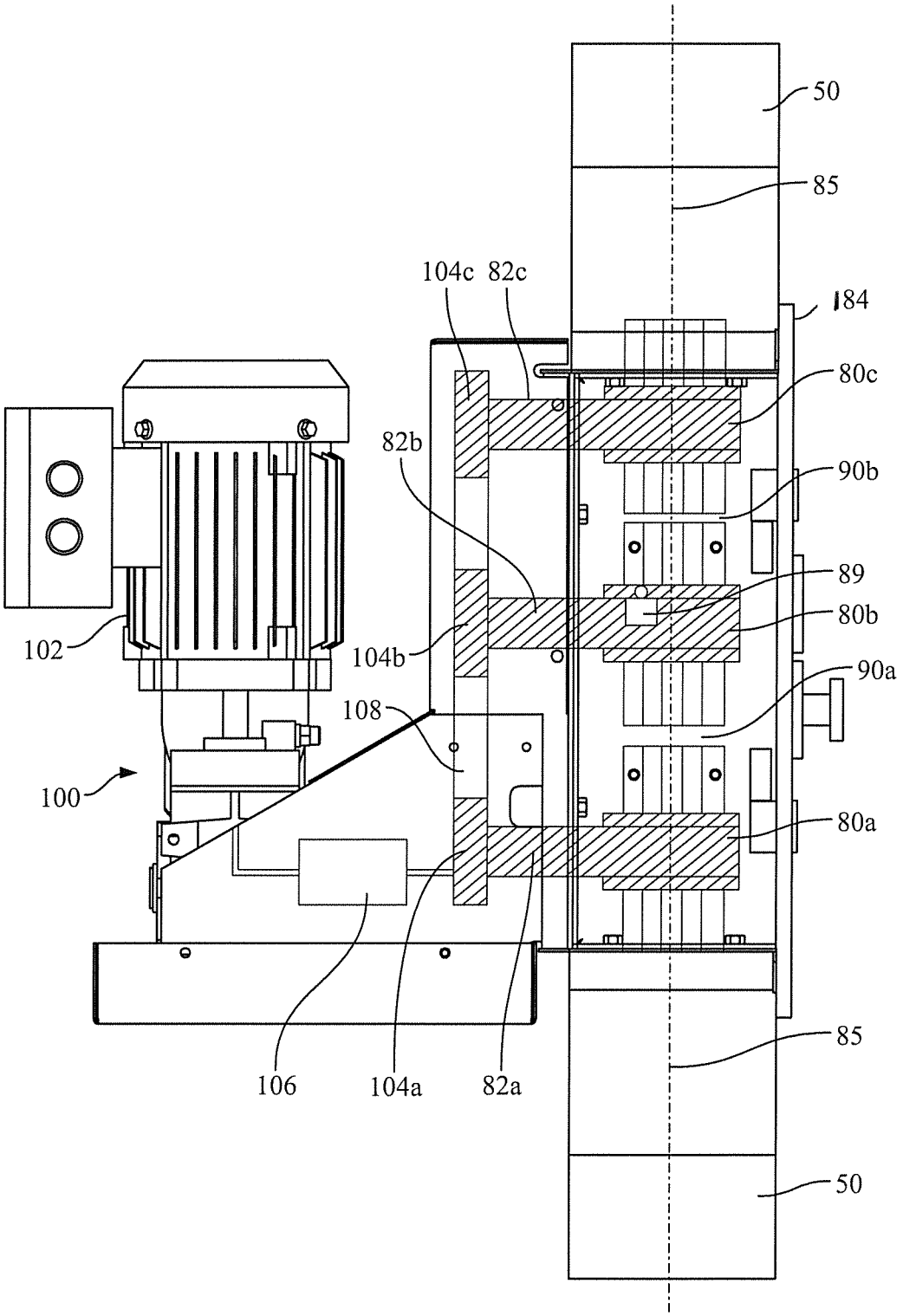
FIG. 3 is a side planar view of the string filter shown in FIG. 1 according to an embodiment, with portions of a drive system shown in cross section.
Figure 8:
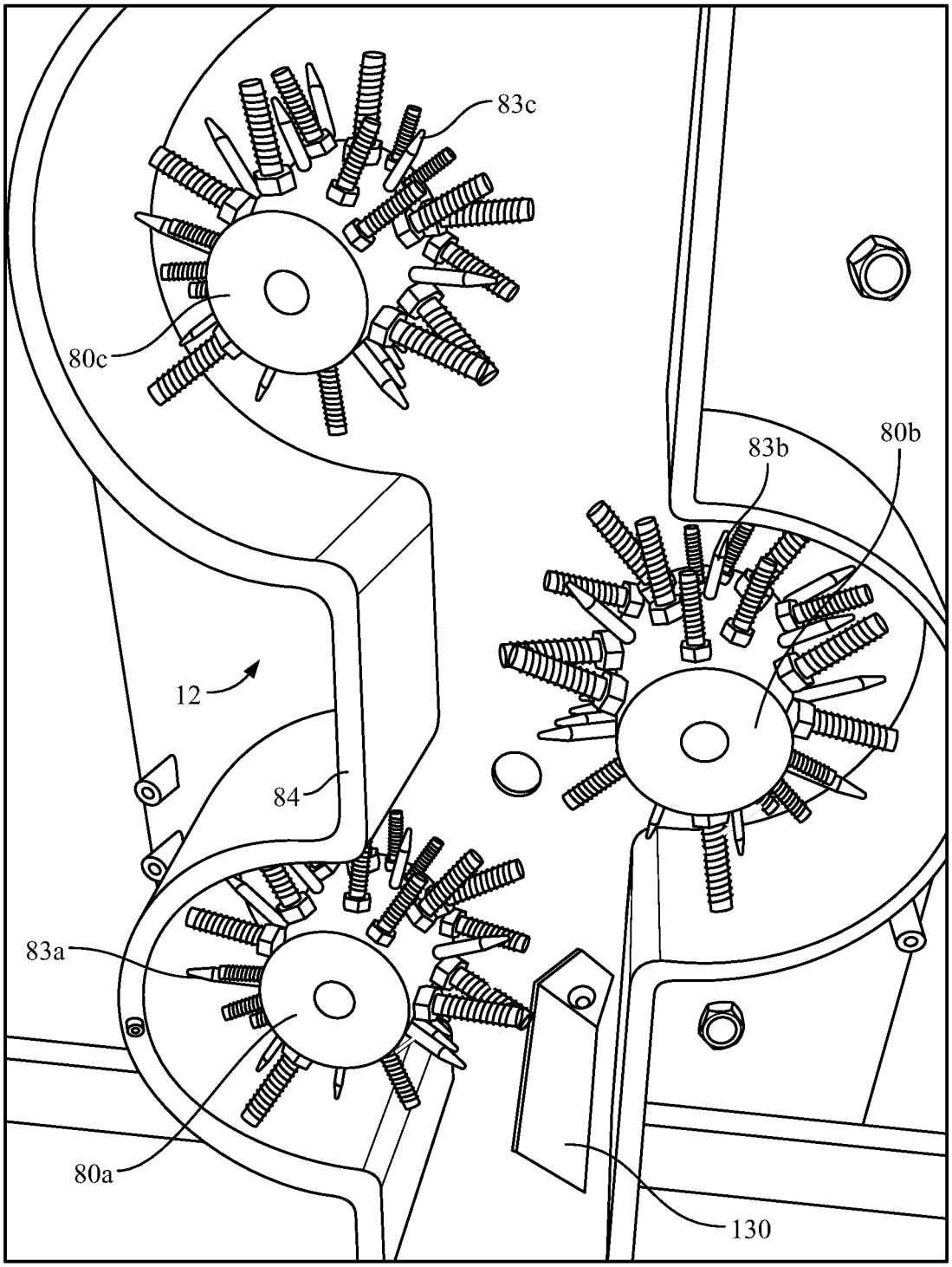
FIG. 8 is a perspective view of a string filter constructed in accordance with another embodiment the present disclosure.

Referring now also to FIGS. 3 and 4, in an embodiment, a first, second and third roller 80*a-c* are releasably connected to horizontal drive shafts 82*a-c*. In certain embodiments, the rollers 80*a-c* are mutually aligned along the general direction of the flow path of tobacco represented by dashed line 85 (shown in FIGS. 3 and 4), realizing that as the tobacco passes through the string filter 12 and about the rollers 80*a-c*, the flow may be displaced off that general flow path 85 momentarily. In certain embodiments, the rollers may be aligned in a straight line in both a side planar view and a front planar view, as shown in FIGS. 3-4. In other embodiments the rollers may not be aligned, or may only be aligned in a side planar view but not in a front planar view (as shown in FIG. 8).

In certain embodiments as shown in FIGS. 3 and 4, the rollers 80*a-c* are spaced closely to one another such that they define nip spaces 90*a,b* between adjacent pairs of the rollers 80*a-b-c* (such as in a first instance, between rollers 80*a* and 80*b*, and in a second instance, between rollers 80*b* and 80*c*). In certain embodiments, nip space 90*a* may be the same magnitude as nip space 90*b* such that the distance between 80*a* and 80*b* is the same as the distance between 80*b* and 80*c* (as shown in FIG. 4). In certain embodiments, nip space 90*a* may be different than nip space 90*b* such that the distance between 80*a* and 80*b* is different than the distance between 80*b* and 80*c* (as shown in FIG. 3).

Further, in certain embodiments, more than or less than three rollers may be used, and the spacing between each pair may be the same or different as the spacing between other pairs. Further, in certain embodiments, no nip space may exist between adjacent rollers, or adjacent rollers may overlap with each other such that no nip space exists between the rollers, and/or such that pins of adjacent rollers at least partially rotate through the same space, for example, in one or more planar views.

Also, in certain embodiments, the rollers 80*a-c* may be driven such that adjacent pairs of rollers rotate in opposite directions of one another. For example the first roller 80*a* may be driven to rotate in a clockwise direction and the second roller 80*b* would be driven in a counterclockwise direction and the third roller 80*c* would be driven in a clockwise direction. Such arrangement may direct the tobacco stream flow in a serpentine way through the string filter 12 as is represented by the arrow designated 87 in FIG. 4. In other embodiments adjacent pairs of rollers, or all the rollers may be driven to rotate in the same direction.

Figure 7:
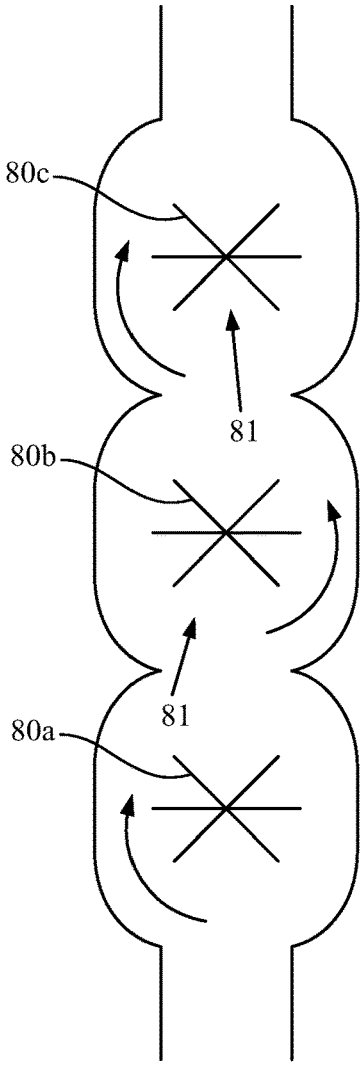
FIG. 7 is a planar frontal representation of roller rotation of the string filter shown in FIG. 1 according to an embodiment.

Still referring to FIG. 4, the housing 84 may be provided with a pair of mutually opposing baffles 86*a*, 86*a'* and mutually opposing baffles 86*b*, 86*b'*, with each baffle 86 extending from one of the side walls 98, 99 of the housing 84 toward the center of the housing at least in one direction, and/or toward the nip space between rollers when nip space exists. The baffles 86*a-a'*, 86*b-b'* may be radially spaced from and generally concentric with the arcuate sweep of the pins 83*a-c* of the rollers 80*a-c*. In certain embodiments, the spacing of the rollers 80*a-c* along the path 85 and the spacing of the baffles 86 from the arcuate sweep of the pins 83*a-c* are selected such that the baffles together with the rotation of the pins 83 may be configured to direct the flow of the entrained tobacco from that roller 80*a* toward a central portion 81 of the next roller 80*b* (see FIG. 7) and continue the flow as shown in FIG. 7.

Referring now also FIG. 4, if the first roller is the roller 80*a* in FIG. 4 (which rotates in a clockwise direction per an example embodiment), it is believed that the left baffle 86*a* may help direct flow of the entrained tobacco toward the central portion 81 of the next roller 80*b*, whereas it is believed that the right baffle 86*a'* may serve to impede a tendency of the entrained tobacco to bypass the next roller 80*b*.

Referring now to FIG. 3, in certain embodiments a driver (or drive system) 100 may be used for driving the rotation of the rollers 80*a-c*, and may comprise an electric motor 102 which may be drivingly connected to rotatable pulleys 104*a-c* through a suitable mechanical link 106 and one or more drive belts 108 that extend about the pulleys 104*a-c*. Rotational drive may be communicated to each of the rollers 80*a-c* through drive shafts 82*a-c* that extend from the pulleys 104*a-c*, respectively. Each roller 80*a-c* may be connected to its respective driveshaft 82*a-c* via a releasable connection 89 (shown as an example for one of the rollers in FIG. 3) which may comprise a spring loaded key or a spring loaded detent or other suitable release mechanism.

Figure 5:
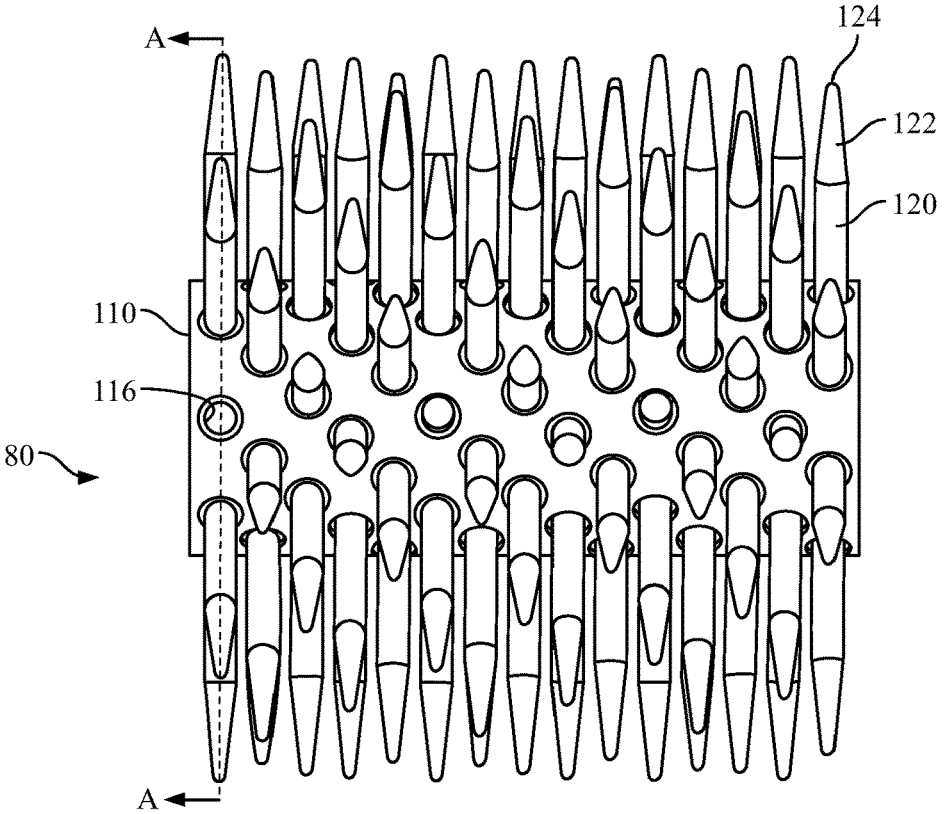
FIG. 5 is a side planar view of a roller comprising pins of the string filter shown in FIG. 1 according to an embodiment.
Figure 6A:
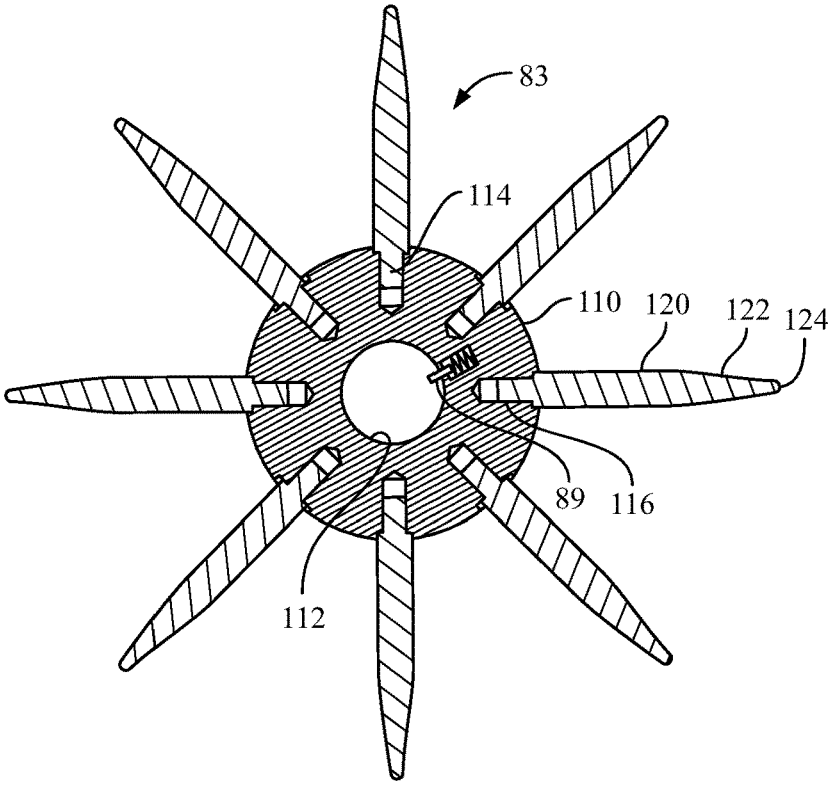
FIG. 6A is a cross-sectional view of the roller shown in FIG. 5, as viewed in the direction of the double arrow A according to an embodiment.

Referring now to FIGS. 5 and 6A, each roller 80 may further comprise a cylindrical body portion (hub) 110 from which extend the plurality of pins 83. In certain embodiments, the hub 110 may include a central bore 112 for releasable engagement with any one of the drive shafts 82*a-c* within the housing 84. In certain embodiments, the rollers 80*a-c* may be duplicates of one another such that when servicing the string filter 12 for maintenance or for removal of captured string, it matters not which roller is placed upon which driveshaft. In other embodiments, one or more rollers may be different, for example, having different dimensions, pins, number of pins, shapes of pins, surfaces, etc. In certain embodiments, the hub 110 may optionally provide housing for the releasable connection 89 in the form of a spring loaded key or the like, whereas other embodiments, the spring loaded key or the like may be disposed upon the drive shafts 82.

Still referring to FIGS. 5 and 6A, in some embodiments each row of pins 83 may be spaced equally from one another about a circumference (such as shown in FIG. 6A), with each row being circumferentially offset from one another so as to establish a helical progression of pins 83 in an axial direction of the hub 110. Other embodiments may use different arrangements and spacings between pins 83. For example, in certain embodiments the pins 83 may not be spaced equally from one another, may not form uniform rows, and/or may be placed using a random spacing. Further, in certain embodiments different pins 83 may have different lengths, shapes, and/or textures.

Figure 6B:
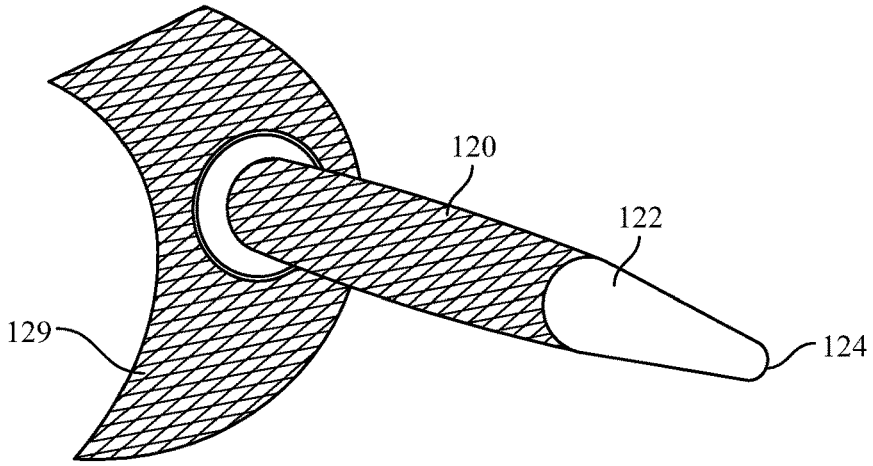
FIG. 6B is a perspective detail of a pin and a surface portion of the roller shown in FIG. 5 according to an embodiment.

In certain embodiments, one or more of the pins 83, or each of the pins 83 may include a base stem portion 114 which may be press fitted, screwed into, or otherwise placed into a respective radial bore 116 provided in the hub 110. A tack weld may be applied at the juncture between the respective pin 83 and the hub 110 to assure retention of the pin 83. One or more pins 83, or of each pin 83 may include an intermediate, cylindrical portion 120 and a tapered end portion 122 which may terminate at a rounded tip 124. In certain embodiments, the tapered portion 122 may be provided with a smooth surface, whereas the cylindrical portion 120 may be provided with a textured surface that is configured to promote capture of string, such as a knurled surface as shown in FIG. 6B. Other forms of textured surfaces could be used in conjunction or instead, such as a dimpled, crosshatched, threaded or other form of texturing. Surfaces 129 of the hub 110 (or its entirety) may also be textured or knurled in a manner that may further promote retention of string upon the roller 80.

Figure 6C:
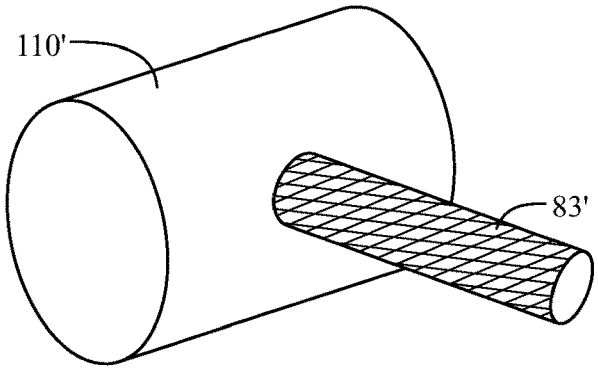
FIG. 6C is a perspective detail of an alternate pin design for the roller shown in FIG. 5 according to an embodiment.

Referring now to FIG. 6C, the pins 83 may be provided with different forms such as a cylindrical form with a flat end portion or other forms. It is also envisioned that shape of the pins 83 may vary from pin to pin, row to row, from one circumferential location to the next, from roller to roller, etc.

In some embodiments, driver 100 drives each of the rollers 80 at a same speed such that the tips 124 of the rollers 80 move at a speed proximate of the speed of the tobacco moving along the conduit 50 at the location of the string filter 12. In certain embodiments, the speed may be approximately 1000 ft./minute or more. Such arrangement may reduce, in certain embodiments, impingement and thrashing of the tobacco shreds with the pins 83. Lesser speeds may also be used. In some embodiments, speeds of different rollers may be different.

It is to be understood that that the vacuum fan 62 of the tobacco feed system may accelerate the tobacco throughout the conduit 50. Accordingly, placement of the string filter 12 close to the tobacco feeder 14 may reduce the speed of the tobacco flow through the string filter 12 in comparison to an embodiment wherein the string filter 12 would be located further along the conduit 50 (closer to the discharger 52).

It is possible to practice the teachings herein with a single roller 80; however in certain embodiments the inclusion of two or more rollers 80 may provide further assurance that string content is effectively removed from a stream of tobacco.

The string filter 12 may also be deployed to capture string segments which might originate from frayed conveyors such as conveyors 27, 27', 27" and/or others.

It is to be understood that although the rollers 80 of certain exemplary embodiments are equally spaced from one another (as shown, for example, in FIGS. 1 and 4), in other embodiments, a pair of adjacent rollers may be spaced further apart from one another than another pair of adjacent rollers within the same string filter 12 (as shown, for example, in FIG. 3).

It is also to be understood that while a string filter 12 is shown and described in a vertical orientation, it could be configured to operate in a horizontal disposition.

In certain embodiments, with the inclusion and operation of a string filter 12 as described above, string segments that may have entered a tobacco stream may be effectively filtered out of the tobacco with little to no degradation of the tobacco. In some embodiments, when string is captured in the string filter 12, the string filter 12 may be configured to facilitate a speedy removal and return of the rollers 80 from and to the housing 84. Such arrangement may facilitate speedy removal of string from individual rollers (and/or replacement of the rollers) with little to no interruption of tobacco feeding operations to the respective cigarette making machine 16. Furthermore, in some embodiments the arrangement and location of the string filter 12 may take advantage of a dispersed state of the tobacco within the conduit 50 to effect string capture with the rollers 80 and their pins 83. Such arrangement avoids having to physically disperse the tobacco across a broad conveyor as is done with string doffers at a stemmery.

Referring now to FIG. 8, the rollers 83 may be configured relative to the general flow path 85 other than the straight alignment shown and described with the first exemplary of embodiment. For example, the rollers 80*a-c* may be offset from one another (and offset from the flow path 85), in which case a baffle 130 may be provided at the entrance to the housing 84 to favorably direct the flow transversely into a central portion of the first roller 80*a*.

In certain embodiments, a filter 12 may be used to de-clump tobacco as tobacco passes through the filter, in addition to or instead of using it to remove string. In certain embodiments, a filter 12 may be used to remove string from materials other than tobacco. In certain embodiments, a filter 12 may be used to remove materials other than string from tobacco, and/or from materials other than tobacco.

It is to be noted that the above teachings are in reference to cigarette making, by way of example. The teachings herein are also applicable to the manufacture and/or filtering of any form of tobacco, the filtering of any shredded material, and/or the de-clumping, removal of material, and/or filtering of any other material as it passes through a filter 12.

Illustrative, non-exclusive examples of apparatus and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

PCT 1. A system for removing foreign matter from shredded material, comprising: an arrangement configured to dispense shredded material from a first location to a second location along a path of communication; and a filter operative at a location along the path of communication comprising a roller comprising pins; whereby foreign matter may be contacted by at least some of the pins and retained at the filter as the shredded material passes through the filter.

PCT 2. The system of PCT 1, further comprising a driver operable to drive rotation of the roller while the shredded material is being dispensed PCT 3. The system of PCT 1 or 2, wherein the foreign material comprises string, the shredded material comprises shredded tobacco, the processing machine comprises a tobacco rod maker and/or the filter comprises a string filter.

PCT 4. The system of PCT 3, wherein the dispensing arrangement draws shredded tobacco along a conduit, the string filter being operative at a location along the conduit, whereby the dispensed shredded tobacco is in a dispersed condition upon arrival at the string filter.

PCT 5. The system of any of PCT 4, wherein the roller comprises a plurality of rollers aligned along a flow path of the conduit, wherein the driver is configured to rotate adjacent rollers of the plurality of rollers in opposite rotational directions.

PCT 6. The system of any of PCT 1-5, wherein the roller comprises a cylindrical body and the pins extend radially from the cylindrical body, wherein at least some of the pins are tapered and include a rounded free end.

PCT 7. The system of any of PCT 3-6, wherein at least some of the pins include a textured surface configured to promote retention of string. and/or at least some of the cylindrical body includes a textured surface configured to promote retention of string.

PCT 8. The system of any of PCT 4-7, wherein the string filter further comprises a housing located along the flow path of the conduit, the housing providing an enclosure for the roller, wherein the housing includes a door configured to provide access to the roller when opened, wherein the string filter further comprises releasable mount for the roller so as to facilitate removal of roller from the housing.

PCT 9. The system of PCT 4 or 5, wherein the string filter further comprises a housing located along the flow path of the conduit, the housing enclosing the plurality of rollers, the housing including an pair of arcuate baffles extending from opposite walls of the housing, the pair of arcuate baffles extending laterally toward a nip space defined between adjacent rollers of the plurality of rollers.

PCT 10. The system of PCT 9, wherein at least one of the baffles directs the shredded tobacco from one of the rollers toward a central portion of an adjacent roller.

PCT 11. The system of any of PCT 5, 9 or 10, wherein at least one adjacent pair of the plurality of rollers are spaced further apart from one another than another pair of adjacent rollers of the plurality of rollers.

PCT 12. The system of PCT 9, wherein the string filter comprises a first, a second and a third roller of a common diameter, wherein the driver rotates the rollers at a common rotational speed.

PCT 13. The system of PCT 4, wherein the roller comprises a plurality of rollers disposed along a flow path of the conduit, at least one of the rollers being off-set from the flow path.

PCT 14. A method of removing string from shredded tobacco, comprising: dispensing shredded tobacco from a first location to a second location; while dispensing, filtering the shredded tobacco of string with a string filter by contacting at least some of the shredded tobacco with pins of a roller while rotating the roller; whereby string may be contacted by at least some of the pins and retained at the string filter as the shredded tobacco passes through the filter.

PCT 15. The method of PCT 14, wherein the dispensing comprises drawing shredded tobacco along a conduit, the string filter being operative at a location along the conduit, whereby the dispensed shredded tobacco is in a dispersed condition upon arrival at the string filter.

PCT 16. The method of PCT 15, wherein the dispensing includes drawing the shredded tobacco along the conduit with a vacuum fan.

PCT 17. The method of PCT 15 or 16, wherein the roller comprises a plurality of rollers aligned along a flow path of the conduit, wherein the rotating includes rotating adjacent rollers of the plurality of rollers in opposite rotational directions.

PCT 18. The method of any of PCT 15-17, wherein sting is retained by a textured surface configured on at least portions of the plurality of pins and/or the roller.

PCT 19. The method of any of PCT 15-18, further comprising enclosing the rotating roller in a housing located along a flow path of the conduit and monitoring retention of string through a window provided at the housing.

PCT 20. The method of any of PCT 15-19, wherein the rotating includes rotating the plurality of rollers within a housing of the string filter, the contacting including directing the shredded tobacco from one of the rollers toward a central portion of an adjacent roller with an arcuate baffle extending laterally from within the housing toward a nip space defined between adjacent rollers of the plurality of rollers.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

We claim:

1. A system for removing string from shredded tobacco, comprising:

a dispensing arrangement configured to dispense shredded tobacco from a first location to a second location along a path of communication and draw shredded tobacco along the path of communication from the first location to the second location with a vacuum fan;

a string filter at a location along the path of communication, the string filter including, a housing including, a transparent window, the window configured to allow for monitoring of the string filter, and a first roller including pins, the first roller in the housing, at least some of the pins configured to contact and retain string at the string filter as the shredded tobacco passes through the filter, and at least some of the pins including a textured surface configured to promote retention of string; and a tobacco rod maker, the string filter between the dispensing arrangement and the tobacco rod maker.

2. The system of claim 1, wherein the string filter further comprises:

a driver configured to drive rotation of the first roller while the shredded tobacco is being dispensed.

3. The system of claim 1, wherein the path of communication comprises a conduit, the dispensing arrangement draws shredded tobacco along the conduit, the string filter being at a location along the conduit, and whereby the dispensed shredded tobacco is in a dispersed condition upon arrival at the string filter.

4. The system of claim 1, wherein the string filter further comprises:

a second roller.

5. The system of claim 4, wherein the first roller and the second roller are substantially aligned with each other in a straight line from a side planar view and a front planar view.

6. The system of claim 4, wherein the first roller is configured to rotate in a rotational direction opposite to a rotational direction of the second roller.

7. The system of claim 1, wherein the first roller further comprises:

a cylindrical body and the pins extend radially from the cylindrical body.

8. The system of claim 1, wherein at least some of the pins are cylindrical in whole or in part.

9. The system of claim 1, wherein at least some of the pins are tapered in whole or in part.

10. The system of claim 1, wherein at least some of the pins include a rounded end.

11. The system of claim 7, wherein at least some of the cylindrical body includes a textured surface configured to promote retention of string.

12. The system of claim 1, wherein at least one of the textured surfaces is knurled.

13. The system of claim 1, wherein the string filter further comprises:

a releasable mount for the first roller, the releasable mount configured to facilitate removal of the first roller from the housing.

14. The system of claim 4, wherein the string filter further comprises:

a second roller in the housing, the housing including an arcuate baffle extending laterally toward a nip space defined between the first roller and the second roller.

15. The system of claim 4, wherein the housing encloses the first roller and the second roller, and the housing includes a set of two arcuate baffles extending laterally from opposing side portions of the housing toward each other.

16. The system of claim 14, wherein the arcuate baffle is configured to direct the shredded tobacco from the first roller toward a central portion of the second roller.

* * * * *